United States Patent [19]

Allsop et al.

[11] 4,244,602

[45] * Jan. 13, 1981

[54] SHOCK-ABSORBING SKI POLE GRIP AND METHOD OF ADJUSTING THE SAME

[75] Inventors: Jon I. Allsop; Donald J. Stern, both of Bellingham, Wash.

[73] Assignee: Allsop Automatic, Inc., Bellingham, Wash.

[ * ] Notice: The portion of the term of this patent subsequent to Dec. 6, 1994, has been disclaimed.

[21] Appl. No.: 825,060

[22] Filed: Aug. 16, 1977

Related U.S. Application Data

[63] Continuation-in-part of Ser. No. 787,424, Apr. 14, 1977, abandoned, which is a continuation-in-part of Ser. No. 691,718, Jun. 1, 1976, Pat. No. 4,061,347.

[51] Int. Cl.[3] ..... A63C 11/22

[52] U.S. Cl. ..... 280/821

[58] Field of Search ..... 280/11.37 H, 11.37 D, 280/11.37 B, 11.37 F, 11.37 N, 11.37 L, 819, 821, 823

[56] References Cited

U.S. PATENT DOCUMENTS

| | | | |
|---|---|---|---|
| 2,478,667 | 8/1949 | Shellhouse et al. | 135/53 |
| 3,076,663 | 2/1963 | Scott | 280/11.37 N |
| 3,486,515 | 12/1969 | Chrysostomydes | 135/50 |
| 3,637,229 | 1/1972 | Klemm | 280/11.37 P |
| 3,797,845 | 3/1974 | Kepka et al. | 280/11.37 B |
| 3,948,535 | 4/1976 | Negi | 280/11.37 B |
| 4,061,347 | 12/1977 | Stern et al. | 280/11.37 H |

FOREIGN PATENT DOCUMENTS

| | | | |
|---|---|---|---|
| 2130838 | 1/1972 | Fed. Rep. of Germany | 280/11.37 Z |
| 2055553 | 5/1972 | Fed. Rep. of Germany | 280/11.37 D |
| 2055597 | 5/1972 | Fed. Rep. of Germany | 280/11.37 D |
| 77061 | 8/1946 | Norway | 280/11.37 N |
| 132429 | 7/1951 | Sweden | 280/11.37 D |

*Primary Examiner*—David M. Mitchell

*Attorney, Agent, or Firm*—Hughes, Barnard & Cassidy

[57] ABSTRACT

A shock absorbing ski pole having a hand grip mounted for up and down motion on the upper end of the ski pole. To cushion shocks imparted to the ski pole, a pneumatic cylinder and piston assembly is mounted in the upper end of the ski pole and operatively connected between the hand grip and the shaft. In addition, a compression spring is mounted in the upper end of the shaft to urge the hand grip to an upper position and also cushion impacts on the ski pole. An elongate friction and positioning sleeve is positioned securely within the hand grip and frictionally engages the outer surface of the upper end of the shaft to provide a frictional drag force and provide firm engagement between the hand grip and the shaft.

The components are so arranged that the length of the pole can be conveniently adjusted by disassembling the shock absorbing components, cutting the upper end of the shaft to a desired length, and reassembling the shock absorbing components in the upper end of the shaft, with the components being held in place by means of a pin engaging a pair of holes in the shaft at a second lower location.

64 Claims, 25 Drawing Figures

FIG. 3
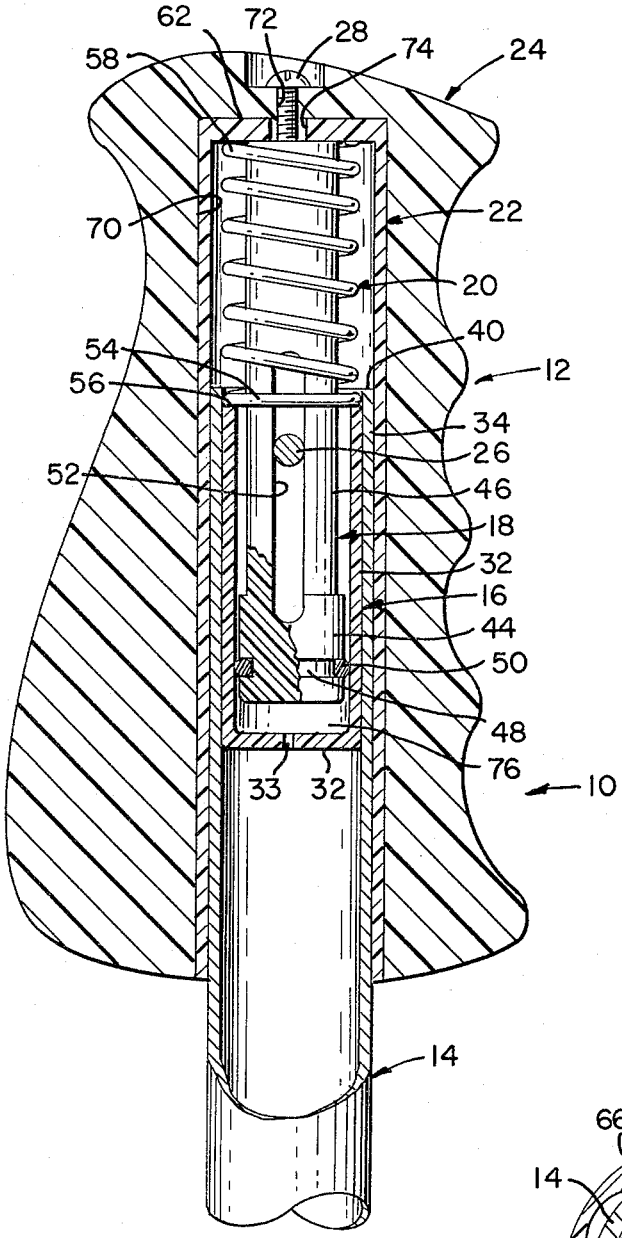
FIG. 4
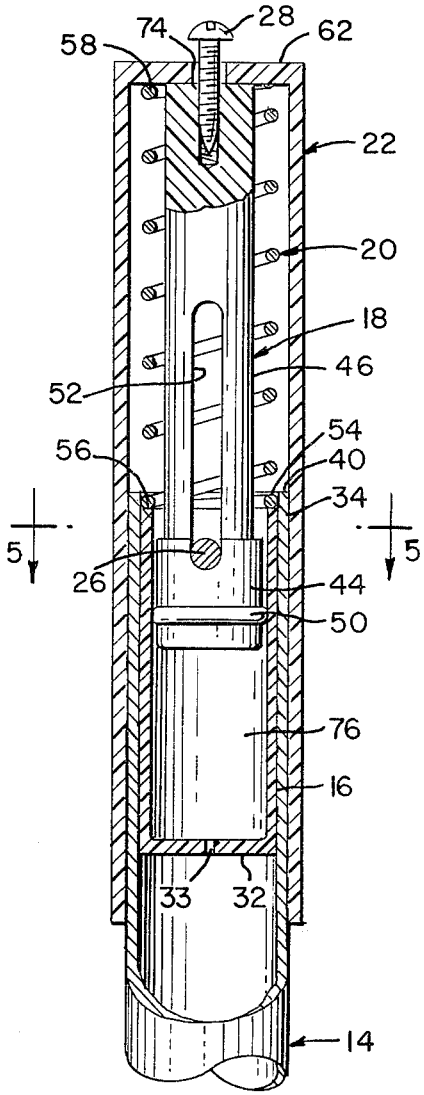
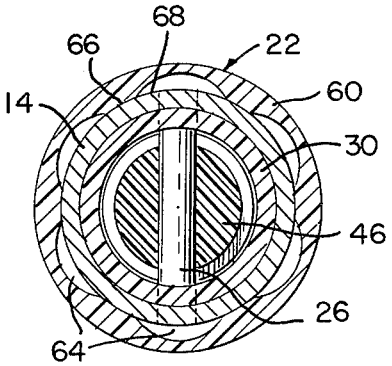
FIG. 5

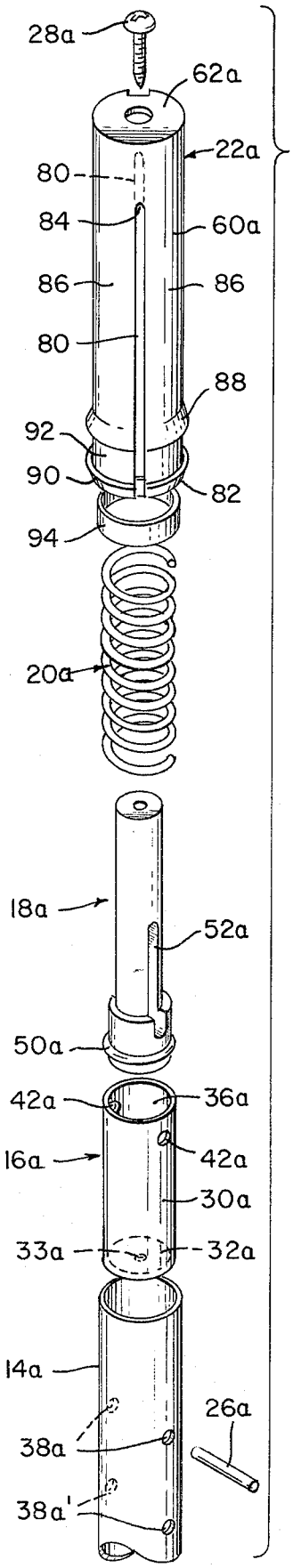
FIG. 6
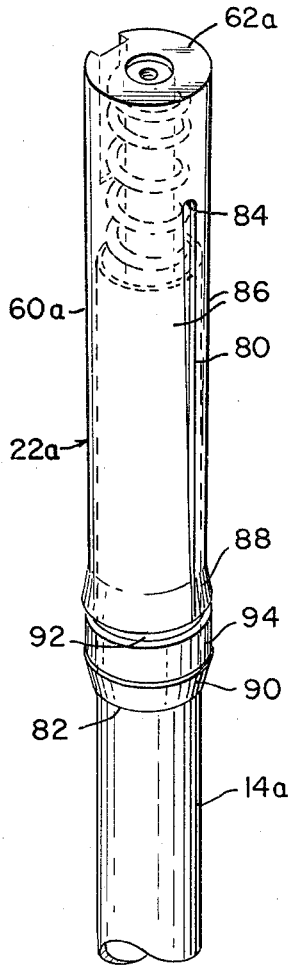
FIG. 7
FIG. 8
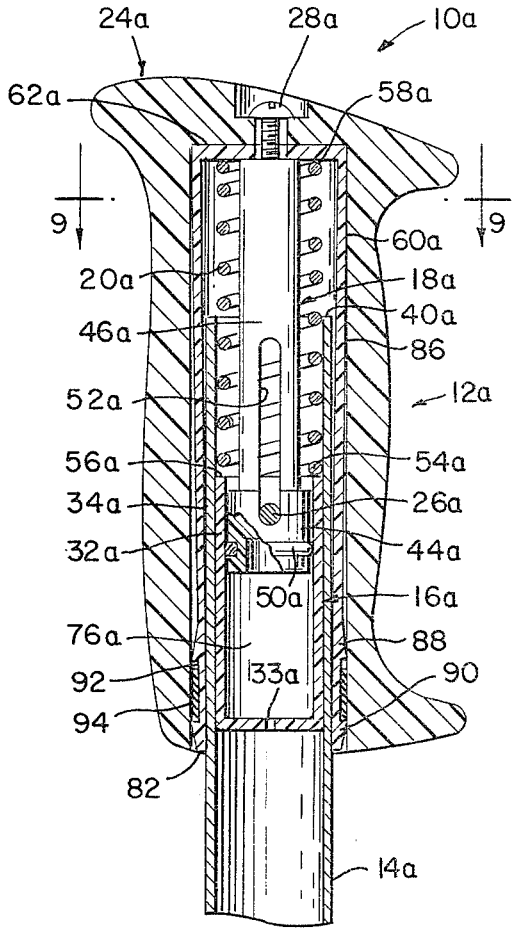
FIG. 9
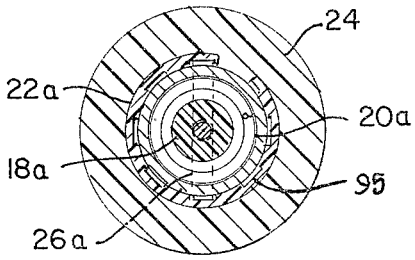

22f
60f 22f
104
106
60f
14f 22e
60e
102

22e
102

22d
60d 22d
100

22c
94c
98

22c
98

96
60b
22b
96

22b
96

FIG. 15
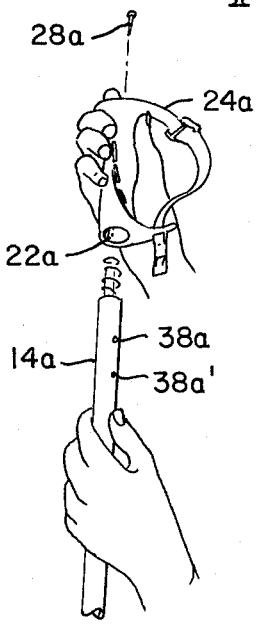
FIG. 16
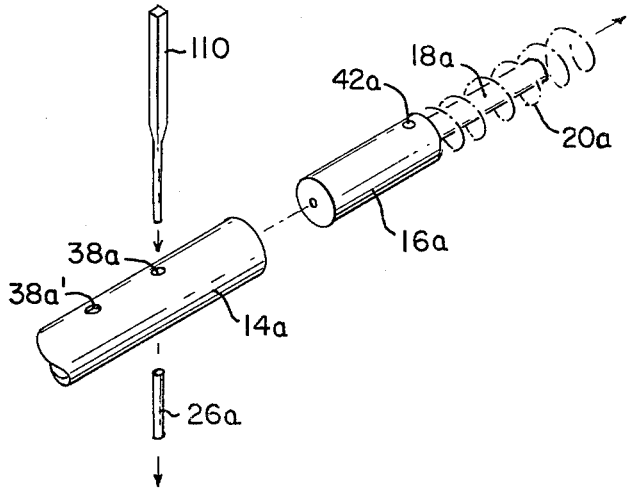
FIG. 18
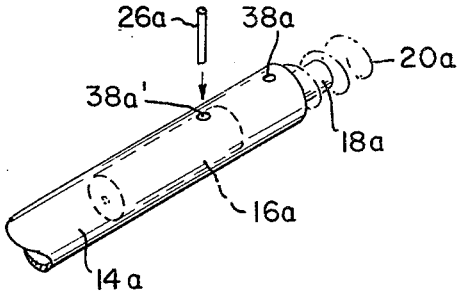
FIG. 17
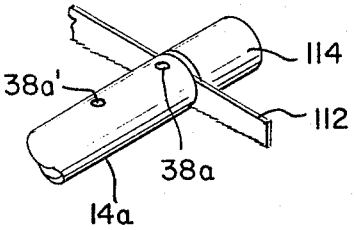
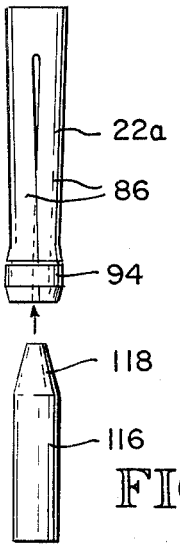
FIG. 19
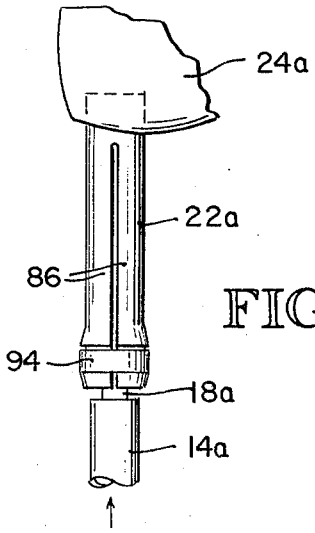
FIG. 20
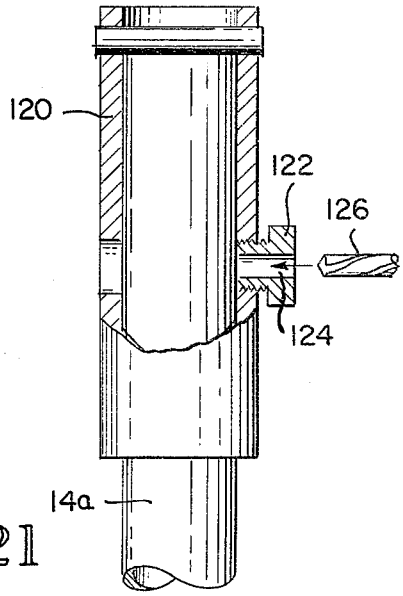
FIG. 21

SHOCK-ABSORBING SKI POLE GRIP AND METHOD OF ADJUSTING THE SAME

CROSS REFERENCE TO RELATED APPLICATIONS

This is a continuation-in-part application of U.S. Ser. No. 787,424, filed Apr. 14, 1977 and now abandoned, which is a continuation-in-part application of U.S. Ser. No. 691,718, filed June 1, 1976, now U.S. Pat. No. 4,061,347.

BACKGROUND OF THE INVENTION

A. Field of the Invention

The present invention relates to ski poles, more particularly to shock absorbing ski poles, and to a method of adjusting the length of ski poles having shock absorbing devices therein.

B. Brief Description of the Prior Art

A number of skiing maneuvers are executed by the skier planting the ski poles in the snow and pressing downwardly on the poles to support at least part of the skier's weight from the poles. In some instances, the poles are shoved quite abruptly into hard snow, with substantial impact being transmitted through the poles to the skier's hands, arms and shoulders.

Since some of these manuevers are performed rather rapidly, the ski poles should have a proper "feel" for the skier, and they should be easily movable to various positions. Accordingly, in the design of ski poles, careful attention is given to such details as the configuration and weight distribution in the ski poles, the arrangement of the hand grips to give proper control, etc. Thus, while it is desirable to make ski poles quite lightweight and easily maneuverable, it is also desirable that the ski poles give the user the "feel" of firmness and proper support.

There have been attempts in the prior art to provide ski poles with shock absorbing mechanisms to ease the impact transmitted through the poles to the skier. One such device is shown in German Patent No. 2,055,597, where the hand grip for the ski pole is mounted for up and down motion on the upper end of the ski pole. A spring is provided to urge the hand grip to its upper position and thus resist downward movement of the hand grip relative to the pole. A similar device is shown in Swedish Patent No. 132,429. While such devices have some capability in cushioning impacts imparted from the ski pole through the hand grip, there is the problem that the rebound action of the spring produces an undesired effect in the "feel" of the ski pole. Further, in at least some of the prior art devices of this type, there is not the necessary firmness between the hand grip and the pole to give the user the proper feeling of control when the skier is manipulating the ski pole from one position to another.

There have been other attempts to place spring-like mechanisms in the tip end of the pole, such devices being shown in U.S. Pat. No. 3,797,845, Kepka et al, and in U.S. Pat. No. 3,637,229, Klemm. One of the problems with such devices lies in the fact that the tip of the ski pole should be made as light-weight as possible, to enable the skier to rapidly swing the tip of the ski pole from one location to another. Not only do such spring-like devices in the tip of the ski pole add undesired weight, but such mechanisms are at a location in the ski pole where they are subjected to substantial torsion loads. Thus, the mechanism would be more likely to malfunction, and if it were made stronger to avoid such possible malfunctions, even more weight would be added to the tip of the ski pole.

Also, various spring-like cushioning devices are noted in areas other than the ski art, one such area being that of crutches used by people having leg injuries. Since the requirements of provided an effective ski pole are substantially different than those relating to crutches, that art is not considered by the applicants to be closely analogous. However, it is cited herein to fulfill the requirement that all prior art of possible relevance be noted. One such device is shown in U.S. Pat. No. 2,478,667, Shellhouse et al, where there is a crutch having a lower tip end slide mounted in a cylinder. Upward movement of the tip end into the cylinder is resisted by a pneumatic piston and cylinder arrangement, and by a compression spring positioned in the pneumatic chamber between the piston and the end of the cylinder wall. There is in the end wall of the cylinder a check valve which permits outflow of air from the chamber defined by the cylinder, but which resists an inflow of air. Thus, the downward movement of the tip in response to the compression spring expanding is resisted to some extent by lower air pressure in the chamber. There is a second valve which also communicates to the cylinder chamber to control the inflow of air to the chamber. A somewhat similar arrangement is shown in U.S. Pat. No. 3,486,515, Chrysostomides.

To return to a discussion of the prior art relating to ski poles, while there have been previous attempts to incorporate shock absorbing devices into ski poles, to the best knowledge of the applicants herein, none of these have proven to be commercially successful or used to any substantial extent by skiers. It is believed that one of the main reasons for this is that at least some of such prior art devices have suffered what might be called a "pogo stick" effect, in that the ski poles are somewhat "bouncy". While this springiness obviously gives the effect of absorbing impact, it also gives the skier a lack of a feeling of firmness and precision in making his pole plants.

Also, quite likely certain technical problems have contributed for the failure of the prior art to deal with this problem successfully. As indicated earlier, to place such shock absorbing devices at the tip end of the pole adds undesired weight at the place where it is least desired, and also locates the shock absorbing device in an area where it is more likely to encounter damaging torsion loads. On the other hand, placing the device in the upper gripping end of the ski pole proposes a different set of problems. First, the size of the hand grip is necessarily limited, since it must fit comfortably into the hand of the skier, and this necessarily places certain constraints on the sort of mechanism which can be sized to be placed in this area. Secondly, the "feel" in the area of the hand grip is particularly critical. The hand grip must firmly engage the pole in such a manner that there is no "play" in the handle of the pole. In one sense, there are what might be called contradicting requirements in providing an effective shock absorbing ski pole. First, there must be a certain amount of "give" or cushioning, to dissipate the effect of impact transmitted through the pole. On the other hand, the "feel" of the pole should be such that the skier senses complete firmness and control in manipulating the pole, planting it for a manuever, and withdrawing it for a subsequent maneuver.

Another consideration is the maintenance and adjustment of the ski poles. For reasons of economy, ski shops prefer not to handle ski poles in a great variety of lengths, simply to keep the inventory to a practical minimum. On the other hand, skiers quite often want precise adjustments in the length of the ski pole. Therefore, it is a common practice in ski shops to adjust the length of a conventional ski pole simply by removing the hand grip from the ski pole, sawing off the desired amount from the upper end of the pole and then replacing the hand grip. Thus, any attempt to provide a ski pole with a shock absorbing device should be compatable with the capability of easy adjustment in the length of the ski pole.

In view of the foregoing, it is an object of the present invention to provide a shock absorbing ski pole which provides a desirable balance of features such as those considered above. More specifically, it is an object to provide a ski pole which effectively absorbs shock impacts transmitted through the pole, provides a proper "feel" of firmness and control for the skier, and yet provides ready adjustment of length in the ski pole.

SUMMARY OF THE INVENTION

The ski pole of the present invention is capable of absorbing impacts transmitted through the ski pole during use, while providing proper "feel" and control for the user, and is capable of convenient length adjustment in small increments by shortening the pole at the handle portion thereof.

The ski pole comprises a hollow shaft having a lower snow engaging end and an upper hand engaging end, with a hand grip mounted circumjacent to the upper end of the shaft. A pneumatic cylinder and piston assembly is mounted to the upper end of the shaft. This assembly comprises a first cylinder member fixedly connected to one of said shaft and hand grip, and a piston member fixedly connected to other of said shaft and hand grip and positioned for reciprocating motion in the cylinder. The cylinder and piston together define an air compression chamber to resist relative movement of the hand grip downwardly relative to the shaft. Further, in a preferred configuration, the chamber is provided with a bleed orifice to cause the cylinder and piston assembly to function in the manner of a dash-pot to reduce the tendency of the compressed air to produce a resilient rebound effect in the return movement of the hand grip.

Spring means are mounted to the upper end of the shaft to resist downward movement of the hand grip relative to the shaft and urge the hand grip to an upper position with a first force of a predetermined value. Stop means limits the upward and downward movement of the hand grip relative to the shaft.

An elongate friction and positioning sleeve is positioned within the hand grip in a manner to frictionally engage the outer surface of the upper end of the shaft to exert a frictional force resisting up and down movement, this force being less than the first force exerted by the spring. This sleeve engages the upper end of the shaft along the length thereof to resist even very slight relative rotational movement of the hand grip relative to the shaft about an axis perpendicular to the lengthwise axis of the shaft. Thus, when the ski pole is being manipulated with its snow engaging end free of the snow, the friction and positioning sleeve provides firm engagement between the hand grip and the shaft to give a secure "feel" to the ski pole. Further, when the ski pole is planted in the snow surface to push the hand grip downwardly, so as to compress the spring means and pressurize the compression chamber to absorb the impact, the friction sleeve resists return movement of the hand grip to dampen any resiliency in the return motion of the hand grip and thus maintain the firmness in the "feel" of the ski pole.

In the preferred form, the friction and positioning sleeve has a cylindrical configuration with two diametrically opposed elongate slots extending from the lower end thereof to a location moderately below the upper end thereof. These slots permit the sleeve to be compressed radially inwardly for proper engagement with the shaft. A tension member such as a resilient band (e.g., a rubber band) is placed around the lower end of the sleeve to provide the proper frictional engagement of the sleeve against the shaft.

The band which grips the slotted sleeve performs a dual function. First, it provides the proper gripping engagement from the handle to the shaft to give a secure "feel" in the hand grip relative to the shaft. Second, it urges the inner sleeve surface into contact with the pole surface to provide the proper resisting frictional force. To provide a proper balance between these two forces (i.e., the gripping force and the frictional force which resists slide motion), the coefficient of friction between the sleeve and the shaft should be relatively low. It has been found that when the outer surface of the shaft is covered with an epoxy paint, and the sleeve is made of nylon, the coefficient of friction is such that there is the proper balance between these two forces. The coefficient of friction should be no greater than about 1.0, with an adequate range being between about 0.3 to 0.7, and desirably between about 0.4 to 0.6. In one actual embodiment of the present invention, the coefficient of friction was approximately 0.5.

Within the broader scope of the present invention, various modifications are possible in the configuration of the friction and positioning sleeve. One modification is to provide the sleeve with a plurality of staggered longitudinally aligned slots around the cylindrical surface of the sleeve, with the proper resiliency being provided by the resiliency of the sleeve material itself.

A second modification is to provide a higher number of elongate slots, somewhat in the same manner as the first described embodiment. With this configuration, there is a resilient gripping band around the lower end of the sleeve.

Another possible modification is to provide the sleeve with a fluted configuration where there are inwardly protruding curved ridges which resiliently grip the outer surface of the shaft.

In a further modified version of the sleeve, a spiral slot extends from the lower end of the sleeve upwardly along the length of the sleeve. The sleeve is made of a resilient material, so that the sleeve in effect comprises a continuous spiral band which extends along the length of the shaft in gripping engagement.

Yet another configuration for the sleeve is to provide the shaft with a member having a plurality of elongate ridges which have friction rollers therein, with the sleeve having a cylindrical configuration and engaging these friction rollers.

In the preferred form of the present invention, the pneumatic cylinder is mounted in the shaft, this cylinder having a side wall fitting against the inner surface of the shaft and a bottom wall extending transversely of the shaft. The piston has a head portion located within the cylinder and an upwardly extending rod having a diameter moderately less than that of the piston head. The spring means comprises a compression spring positioned around the piston rod, the lower end of the spring bearing against the upper edge of the cylinder and extending upwardly to bear against the upper end of the friction and positioning sleeve.

To properly position these components in the shaft, there is provided a mounting pin which extends through diametrically opposed matching holes in the shaft and cylinder. The piston is provided with elongate slots to permit up and down movement of the piston in the cylinder and to also serve as a stop to limit such movement. The friction and positioning sleeve and the hand grip are secured to the upper end of the piston rod by removable fastening means, such as a screw. Also, the sleeve serves to retain the locating pin in its proper position extending across the shaft. The frictional engagement of the locating pin in the slot in the piston and of the cylinder with the piston also aid in dissipating undesired resiliency in the return motion of the piston.

The arrangement of the present invention permits the handle assembly of the present invention to be conveneintly disassembled, the shaft shortened, and the components readily reassembled at a lower location on the end of the shaft. This is readily accomplished by removing the top fastener for the hand grip and the friction and positioning sleeve, and slipping the hand grip and sleeve off the upper end of the shaft. Then the locating pin is removed, after which the cylinder, piston and spring are removed from the shaft. An upper end portion of the shaft is cut off at the proper location to provide a proper length for the shaft, after which the cylinder and piston can be reinserted and the locating pin put in place.

To replace the sleeve on the pole, first the two opposite sections of the sleeve are squeezed inwardly so as to overlap one another, and the resilient band is placed around these two sections. Then a flaring tool is inserted into the open end of the sleeve to spread the two side sleeve sections into a cylindrical configuration, with the edges along the slots abutting against one another to maintain this cylindrical configuration. In this position, the sleeve can quite easily be inserted over the upper end of the pole, and the hand grip placed over the sleeve.

BRIEF DESCRIPTION OF THE DRAWINGS

FIG. 3 is a longitudinal sectional view taken along line 3—3 of FIG. 1, with the hand grip being shown pressed to a down position relative to the shaft, as in absorbing an impact load on the shaft;

FIG. 4 is a view similar to FIG. 3, but showing the assembly of FIG. 3 in its up position;

FIG. 5 is a sectional view taken along line 5—5 of FIG. 4;

FIG. 6 is an exploded view of the components of a second preferred embodiment of the present invention;

FIG. 7 is a perspective view showing the components of FIG. 6 in assembled position;

FIG. 8 is a longitudinal sectional view of this second preferred embodiment;

FIG. 9 is a sectional view taken along line 9—9 of FIG. 8;

FIGS. 10A through 14A are perspective views of modified forms of the friction and positioning sleeve of the present invention;

FIGS. 10B through 14B are bottom plan views of the modified sleeves shown in, respectively, FIGS. 10A through 14A;

FIGS. 15 through 20 are views illustrating the manner in which the ski pole of the present invention can be shortened to a desired length, these views illustrating the disassembly, cutting of the ski pole, and reassembly of the components; and FIG. 21 illustrates the manner in which a locating hole could be drilled in the upper end of the shaft at the desired location.

DESCRIPTION OF THE PREFERRED EMBODIMENTS

Figure 1:
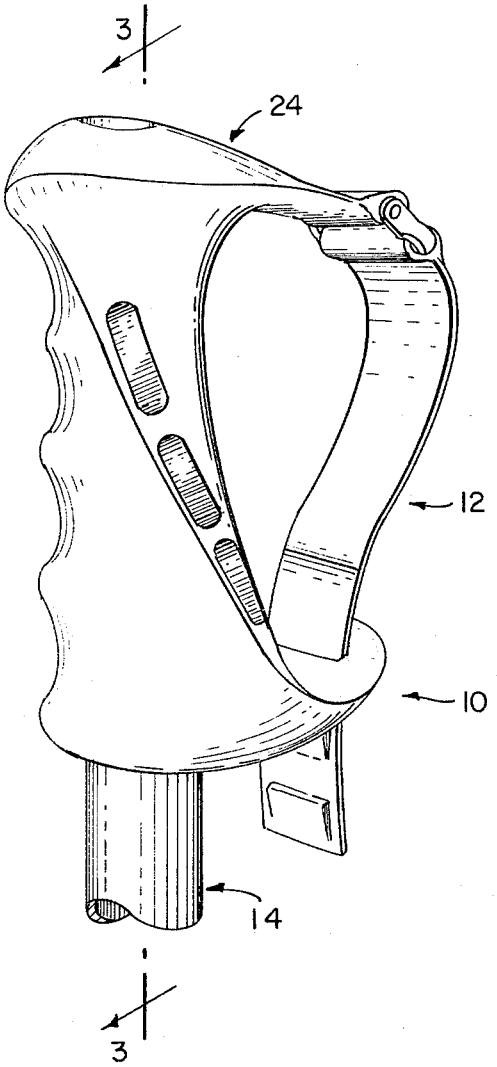
FIG. 1 is a perspective view of a hand grip of the present invention incorporating the shock absorbing components therein.
Figure 2:
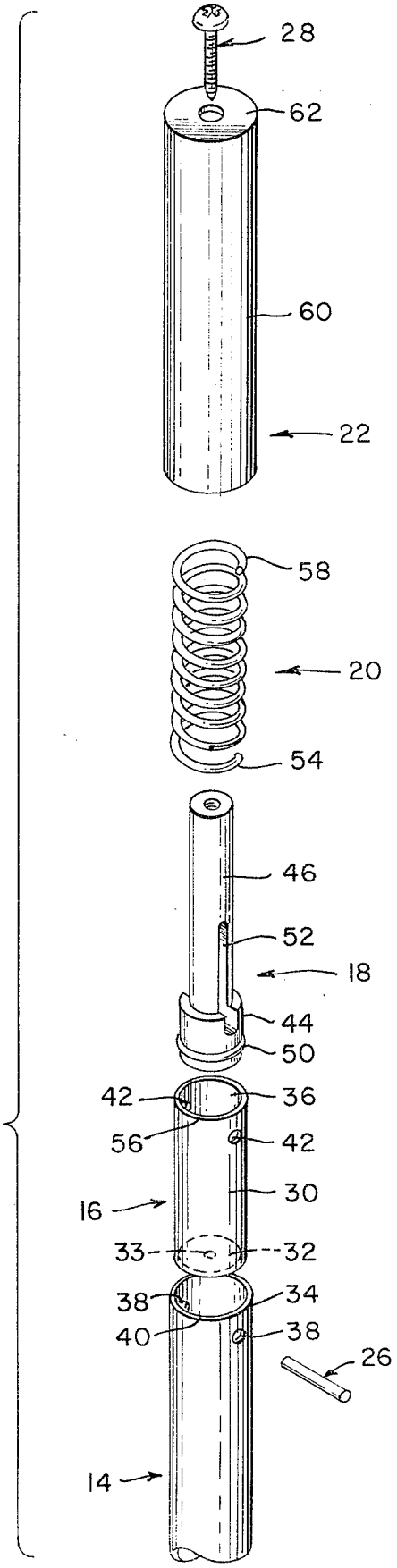
FIG. 2 is an exploded isometric view of the components which comprise a first embodiment of the shock absorbing hand grip assembly of the present invention.

A first earlier developed embodiment of the ski pole of the present invention is illustrated in FIGS. 1 through 5. This ski pole is generally designated 10, and comprises a shock absorbing hand grip assembly 12 and a shaft 14. In the drawings, only the upper portion of the shaft 14 is shown, since the main body of the shaft and the lower tip portion thereof, are, or may be, of conventional design. The main components of the hand grip assembly 12, are: a cylinder 16, a piston 18, a compression spring 20, a friction and positioning sleeve 22, a hand grip member 24, a locating pin 26, and the removable fastening member in the form of a screw 28.

The cylinder 16 comprises a cylindrical side wall 30 and a bottom wall 32. The bottom wall 32 of the cylinder 16 has a quite small bleed orifice 33, the function of which will be described later herein. In the assembled position, the cylinder 16 is placed in the upper end 34 of the shaft 14, with the upper open end 36 of the cylinder 16 facing upwardly. The shaft 14 has a pair of diametrically opposed through holes 38 positioned moderately below the upper edge 40 of the shaft 14, and the cylindrical side wall of the cylinder 16 has at its upper end a pair of matching aligned through holes 42. In the assembled position, the locating pin 26 extends through both sets of holes 38–42 to hold the cylinder 16 in its proper position within the shaft 14. The diameter of the cylinder 16 is such that it fits within the interior of the shaft 14 with a very slight clearance.

The piston 18 comprises a piston head 44 and an upwardly extending rod 46. The piston head 44 fits within the cylinder 16 with a relatively close tolerance fit, and it has a circumferential groove 48 in which is fitted an "O" ring 50 to provide a proper seal between the cylinder 16 and piston 18.

The piston 18 is provided with a longitudinal through slot 52 to receive the locating pin 26 and permit up and down movement of the piston 18 within the cylinder 16. The arrangement of the slot 52 and pin 26 serves not only the function of limiting relative rotation of the components in the shaft 14, but it also provides a stop means to limit upward and downward movement of the piston 18.

The compression spring 20 has a lower end 54 which bears against the upper edge 56 of the cylinder 16, and the upper end 58 of the spring 20 bears against the upper portion of the aforementioned friction and positioning sleeve 22.

The friction and positioning sleeve 22 has a generally cylindrical configuration and comprises a cylindrical side wall 60 and a circular top wall 62. The interior surface of the cylindrical side wall 60 has a plurality of longitudinally extending cut-outs 64 which form therebetween a plurality of longitudinal ridges 66 which extend inwardly to grip the outer surface 68 of the shaft 14. The sleeve 22 is made of a moderately resilient material, such as nylon or nylon impregnated with silicone, and is sized so that the ridge members 66 grip the shaft 14 with the desired firmness. Also, the coefficient of friction between the cylindrical side wall 60 and the shaft 14 is relatively low to provide the proper frictional resisting force to longitudinal slide movement of the sleeve 22 relative to the shaft 14, while maintaining the proper gripping force of the sleeve 22 around the shaft 14.

The hand grip 24 is made of a moderately yielding plastic material and has an interior cylindrical recess 70 to fit snugly over the sleeve 22. The top end of the hand grip 24 and the top wall 62 of the sleeve 22 have aligned openings 72 and 74 to receive the screw 28 which is threaded into the upper end of the piston rod 46 to hold the hand grip 24 and sleeve 22 securely to the piston rod 46. The hand grip 24 is properly contoured to provide for convenient gripping by the skier's hand.

To describe the operation of the present invention, with the hand grip assembly 12 in its assembled position, let it be assumed that the skier plants the pole 10 firmly and sharply into relatively hard snow so that there is a substantially shock impact transmitted upwardly through the shaft 14, with the skier grasping the hand grip 24 and pressing it downwardly onto the upper end of the shaft 14. As the downward movement of the shaft 14 is abruptly stopped as it encounters the snow, the hand grip 24, sleeve 22 and piston 18 being fixedly secured to one another, move downwardly relative to the shaft 14. This causes the spring 20 to be compressed between the upper portion of the sleeve 22 and the upper edge 56 of the cylinder 16, with the spring 20 providing some resistance to downward movement of the hand grip 24 and the components connected thereto. At the same time, as the piston 18 moves downwardly in the cylinder 16, there is compression of the air in the compression chamber 76 defined by the piston head 44 and the cylinder 16.

The bleed orifice 33 is made quite small (e.g. eight-thousandths to as small as four-thousandths of an inch in diameter) relative to the volume of the compression chamber 76 (this chamber 76 being about ½ inch in diameter and about one inch long). Thus the initial and rather rapid compression which occurs in the chamber 76 caused by the very sharp downward movement of the hand grip 24 and cylinder 18 is not immediately dissipated by the bleed orifice 33. Rather, the pressure in the chamber 76 is able to build up to an extent sufficient to provide substantial cushioning to the downward movement of the piston 18. Since the increase in pressure in the chamber 76 is approximately inversely proportional to the decrease of volume in the chamber 76 (disregarding for the moment the effects of momentary increase in the temperature of the air being compressed and the opposite effect of the air bleeding through the orifice 33), it will be appreciated that the cushioning force provided by the compressed air in the chamber 76 can be rather large, particularly where the pole 10 is pushed into hard snow rather rapidly and with a very substantial push from the skier's hand.

During the time that the skier is executing his maneuver and maintains downward pressure on the hand grip 24, air bleeds through the orifice 33 into the interior of the shaft 14 to reduce the resisting force provided by the air in the compression chamber 76. By the time the skier completes the maneuver and releases his downward pressure on the hand grip 24, the pressure in the chamber 76 has largely dissipated, and the spring 20 supplies the main restoring force to push the sleeve 22, hand grip 24 and piston 18 upwardly to the up position shown in FIG. 4. As the piston 18 moves upwardly, there is a pressure reduction in the chamber 76 which retards upward movement of the piston 18.

The functions supplied by the friction and positioning sleeve 22 are rather critical to the operation of the present invention. As indicated previously, the sleeve 22 fits snugly within the hand grip 24, and also grips the shaft 14 firmly along the length of its upper end portion. Thus, as the skier swings the pole 10 to the position to make the pole plant, there is substantially no play or looseness between the hand grip 24 and the shaft 14 so that the pole 10 has the proper feel of firmness. As the pole 10 is planted abruptly in the snow, the frictional engagement of the sleeve 22 against the shaft 14 provides a resisting frictional force to the downward movement of the sleeve 22 and the hand grip 24. Also there is the frictional force between the piston head 44 (more specifically the "O" ring 50) and the cylinder 60, and also the frictional force between the piston 18 and the pin 26. However, it is to be understood that the resisting forces provicded by the frictional engagement of the sleeve 22 aginst the shaft 14 and of the piston head 48 against the cylinder 16 and the pin 26 are relatively small compared to the resisting force to downward movement provided by the combined action of the spring 20 and the pressurizing of the compression chamber 76.

When the skier lifts the pole 10 from the snow surface, in most instances the pressure in the chamber 76 has been largely dissipated through the bleed orifice 33, and it is mainly the force of the compression spring 20 which returns the hand grip 24 to its up position. However, on the upward travel of the hand grip 24, the frictional forces between the sleeve 22 and the pole 10 and between the piston head 44 and the cylinder 16 are opposite to that exerted by the spring 22. In this instance, this frictional force and the retarding effect of the reduced pressure in the chamber 76 dissipate what otherwise would be an excessive "rebound" effect caused by the spring 20. The force exerted by the spring 20 is substantially greater than the frictional forces provided by the sleeve 22 and piston head 44 so that the spring 20 is able to return the hand grip 24 promptly to its up position upon release of the downward pressure on the hand grip 24.

From the foregoing discussion of the operation of the present invention, it becomes apparent that the relationship of the force component supplied by the cooperating action of the several components of the present invention becomes rather critical. Since some of these forces depend upon frictional engagement, it further becomes apparent that this relationship is affected by the practical problems of manufacturing and assembling the apparatus of the present invention. For example, there are certain tolerances in the manufacture of the shaft to a predetermined cylindrical configuration of the proper diameter, which in turn must be coordinated with the sizing of the sleeve 22 to insure proper engagement. Thus, while the embodiment shown in FIGS. 1 through 5 has proven to be an effective shock absorbing ski pole, there was effort for yet further improvements which led to the embodiment shown in FIGS. 6 through 9.

In describing the components of the second embodiment, components which are similar to the first embodiment will be given like numerical designations, with an "a" suffix distinguishing those of the second embodiment.

The main components of the second embodiment are substantially the same as those of the first embodiment, with the exception of the friction and positioning sleeve 22*a*. Thus, there is a ski pole 10*a* made up of a hand grip assembly 12*a* and a shaft 14*a*. The cylinder 16*a*, piston 18*a*, compression spring 20*a*, hand grip 24*a*, locking pin 26*a*, and retaining screw 28*a* are substantially the same as in the first embodiment. Accordingly, these components will not be described in detail in this description of the second embodiment.

To turn out attention now to the modified friction and positioning sleeve 22*a*, the overall configuration of this sleeve 22*a* is substantially the same as the previously described sleeve 22, in that it has a generally cylindrical configuration and comprises a cylindrical side wall 60*a* and a top wall 62*a*. However, the side wall 60*a* is formed with two elongate, longitudinally aligned, diametrically opposed, substantially identical slots 80, one of which is shown in FIGS. 6 and 7. Each slot 80 extends from the bottom edge 82 of the sleeve 22*a* upwardly to terminate at 84 a moderate distance below the top wall 62*a*. The two slots 80 effectively separate the cylindrical side wall 60*a* into two leg portions 86, each of which has a semi-circular cross-sectional configuration.

These two leg portions 86 are formed at the lower end with a pair of vertically spaced upper and lower lips, 88 and 90, respectively, which define therebetween a rather shallow circumferential depression 92. There is a resilient band 94 which fits in the circumferential depression 92 to compress the lower end of the two leg portions 86 toward one another. This resilient band 94 can be conveniently provided in the form of a rubber band. Elongate vertical cut-outs 95 are formed on the interior surface of the sleeve 22*a* to limit rotation of the sleeve 22*a* about the shaft 14*a* by engaging the pin 26*a*.

The benefits of this arrangement of the slotted side wall 60*a* and resilient band 94 are several. First, it permits greater manufacturing tolerances in the shaft 14*a*, since with the slots 80 and the resilient band 94, it is possible to obtain the proper frictional engagement of the shaft 14 by the sleeve 22*a* over a wider range of variations in the size and configuration of the shaft 14*a*. Second, since the gripping force is supplied mainly by the rubber band 94, there is no need to build the required resiliency into the structure of the sleeve 22*a* itself, and this in turn provides more latitude in the configuration and material selection for the sleeve 22*a*. Thirdly, since the band 94 is located at the lower end of the sleeve 22*a*, secure engagement is provided at the location where it is quite critical for the proper "feel" of firmness between the hand grip 24 and the shaft 14. There is a fourth advantage in that this particular arrangement makes the disassembling and assembling of the component parts relatively easy. This will become more apparent from the description which follows with reference to FIGS. 16 through 21. There is a fifth advantage in that the frictional force supplied by the engagement of the sleeve 22*a* is more constant. This feature will become more apparent from the following description of the operation of the second embodiment.

With the second embodiment 10*a* in its assembled condition, the mode of operation is essentially the same as in the first embodiment. Thus, when the pole 10*a* is planted sharply into hard snow, the hand grip 24*a* is pressed downwardly relative to the shaft 14*a*, compressing the spring 20*a* and moving the piston 18*a* downwardly to pressurize the chamber 76*a*. With regard to providing frictional force between the shaft 14*a* and the sleeve 22*a*, the sleeve 22*a* acts in substantially the same manner as in the first embodiment. However, since there is permitted a fair degree of tolerance in the lateral positioning of the two leg portion 86 of the sleeve 22*a*, and since the resilient band 94 can exert a substantially constant force against these legs 86 to push them inwardly, if there are slight variations in the diameter or configuration of the upper portion of the shaft 14*a* which the sleeve 22*a* engages, the actual variation in the frictional force between the sleeve 22*a* and the shaft 14*a* will vary quite little. Also, since this gripping force is substantially constant, there remains constant firm engagement between the hand grip 24*a* and the shaft 14*a* to provide a constant proper "feel" of firmness.

With regard to the degree of frictional engagement of the sleeve 22*a*, it has been found that if the sleeve 22*a* is made of nylon, and the shaft 14*a* is covered with an epoxy paint, the coefficient of friction between the sleeve 22 and the shaft 14*a* is approximately 0.5. It has been found suitable to select a rubber band 94 which squeezes the two leg portions 86 together with a force of about eight to ten pounds, so that the frictional resisting force between the sleeve 22*a* and the shaft 14*a* is approximately four to five pounds. It has been found satisfactory to select a spring 20 which in its installed position exerts a force of approximately twenty pounds upwardly against the sleeve 22*a*, and when fully compressed exerts a force of about eighty pounds.

Within the broader aspects of the present invention, modified arrangements of the sleeve 22*a* are possible. Some of these are shown in FIGS. 10A through 14A and 10B through 14B.

Figures 10A, 10B, 11A, 11B, 12A, 12B, 13A, 13B, 14A, 14B:
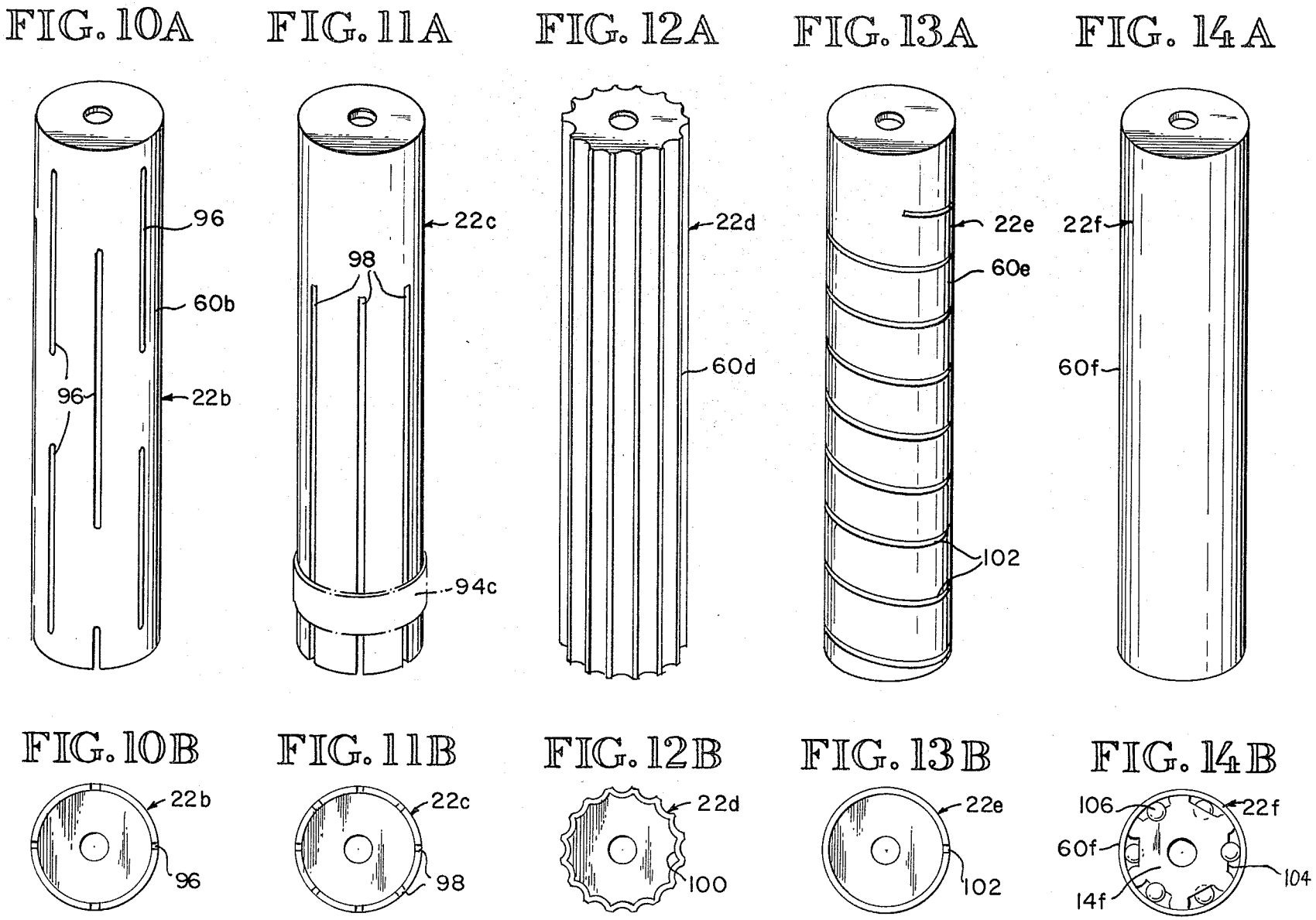

In FIGS. 10A and 10B, there is shown a sleeve 22*b* having a plurality of elongate slots 96 positioned around the circumference of the side wall 60*b*. The verticle position of these various slots 96 is in a staggered pattern so that some of the slots 96 are in the upper portion of the wall 60*b* and some in a lower position, with intermediate slots overlapping both the upper and lower slots 96. The sleeve 22*b* is made of a resilient material so that the cylindrical side wall 60*b* itself provides the gripping force to properly engage the associated shaft, such as the one shown in the other figures at 14 and 14*a*.

In FIGS. 11A and 11B, there is shown a further modified configuration of a sleeve 22*c*, where there are eight elongate slots 98, similar in configuration to the slots 80 of the second embodiment. This sleeve 22*c* is provided with a resilient band 94*c* to insure proper frictional engagement with an associated shaft, such as that shown in the other figures at 14 or 14*a*.

In FIGS. 12A and 12B, a sleeve 22*d* is provided where the cylindrical side wall 60*d* has in transverse section a fluted configuration, wherein there are a plurality of longitudinally extending inwardly protruding curved elements 100 formed in the side wall 60*d*. These elements 100 engage the shaft, such as the one shown at 14 or 14*a* to provide proper frictional engagement. The sleeve 22d is made of a suitable resilient material so that there is sufficient resiliency in the sleeve 22d itself to provide proper frictional engagement.

In FIGS. 13A and 13B, the sleeve 22e is provided with a single continuous slot 102 which extends from the lower end of the sleeve 22e in a spiral configuration to the upper portion thereof. Thus the sleeve side wall 60e is in effect a spiral-shaped resilient band extending substantially the entire length of the sleeve 22e.

In FIGS. 14A and 14B, the sleeve 22f has a conventional configuration. However, the shaft 14f is provided with a plurality of longitudinal recesses 104, in which are positioned in pockets a plurality of friction bearings 106. These bearings 106 are press-fitted into engagement with the cylindrical side wall 60f for proper frictional engagement.

FIGS. 15 through 21 illustrate the manner in which the second preferred embodiment of the present invention (illustrated in FIGS. 6 through 9) can be disassembled to shorten the shaft 14a, and then reassembled to provide a ski pole 14a of a slightly shorter length.

As shown in FIG. 15, the screw 28a is removed and the hand grip 24a and sleeve 22a are slipped off the top end of the pole 14a. A punch 110 is used to drive out the securing pin 26a, and the cylinder 16a, piston 18a and spring 20a are removed from the shaft 14a.

Next, a saw 112 is used to cut a short piece 114 from the shaft 14a. Subsequent to this, as shown in FIG. 18, the cylinder 16a, piston 18a and spring 20a are replaced in the upper end of the shaft 14a. It will be noted that in addition to the positioning poles 38a which were initially provided in the shaft 14a, there are a second set of positioning holes 38a' spaced about an inch below the initial holes 38a. In reassembling the hand grip assembly 12a, the cylinder 16a and the piston 18a are positioned in the upper end of the shaft 14a so that the holes 42a in the cylinder 16a are in alignment with the lower set of holes 38a'. Then the pin 26a is inserted through the aligned holes 38a' and 42a, and also through the elongate slot 52a in the piston 18a.

To place the sleeve 22a back onto the shaft 14a, there is provided a flaring tool 116 having a tapered nose portion 118, First, the two leg portions of the sleeve 22a are pressed toward one another so as to overlap at the lower ends thereof, and the resilient band 94 is slipped over the lower end of these legs 86. Then the nose 118 of the flaring tool is pushed upwardly into the lower open end defined by the two legs 86, so as to spread the two legs 86 outwardly from one another so that the opposed edge portions thereof abut against one another. In this position, the sleeve 22a can be pushed down over the upper end of the shaft 14a, as shown in FIG. 20, and the hand grip 24a is pushed down over the sleeve 22a.

Usually ski poles are provided to the ski shops in sizes which increase in length by increments of two inches. With the second set of locating holes 38a' already provided one inch down from the first set 38a, it is quite simple to shorten the length of the pole by exactly one inch. In the event that the second holes 38a' provided in the initial manufacture of the pole 14a are not properly located, then there is provided a drilling jig, such as that shown at 120 in FIG. 21. This jig is slipped over the top end of the shaft 14a and clamped in the desired position by means of a threaded member 122. This threaded member 122 has a lateral cylindrical opening 124 adapted to receive a drill 126. The drill 126 is moved into the hole 124 and operated to form a pair of opposed through openings at the desired location.

From the foregoing description, it can be appreciated that the shock absorbing components, while being in the hand grip portion of the pole 10a, still permit a quite convenient means for adjusting the length of the pole 10a to a desired length. Also, the arrangement of these components permits reasonable latitude in the manufacturing tolerances of the components, while enabling the components to properly perform their required functions well within the desired operating parameters.

What is claimed is:

1. A shock absorbing ski pole capable of absorbing impacts caused by being planted into snow during use, said ski pole comprising:

a. a hollow shaft having a lower snow engaging end and an upper hand engaging end, b. a hand grip mounted circumjacent to the upper end of said shaft, c. a pneumatic cylinder and piston assembly mounted to the upper end of the shaft, said assembly comprising a first cylinder member fixedly connected to one of said shaft and said hand grip, and a piston member fixedly connected to the other of said shaft and hand grip and positioned for reciprocating motion in said cylinder, said cylinder and piston defining an air compression chamber to resist relative movement of said hand grip downward relative to the shaft, d. spring means mounted in the upper end of said shaft to resist downward movement of the hand grip relative to the shaft and urge the hand grip to an upper position with a first force of a predetermined value, e. stop means to limit upward movement of the hand grip relative to the shaft, and f. an elongate friction and positioning sleeve positioned securely within said hand grip and frictionally engaging the outer surface of the upper end of the shaft to exert a frictional force thereagainst less than the first force exerted by said spring means, said sleeve engaging the upper end of the shaft along the length thereof to prevent movement of the hand grip relative to the shaft about an axis perpendicular to a lengthwise axis of the shaft, while permitting relative movement about an axis parallel to the lengthwise axis of the shaft, whereby when the ski pole is being manipulated with its snow engaging end free of the snow, the friction and positioning sleeve prevents relative movement between the hand grip and shaft in a manner to give a secure feel to the ski pole, and when the ski pole is planted in a snow surface to push the hand grip downwardly so as to compress the spring means and pressurize the compression chamber to absorb the impact, said friction and positioning sleeve resists return movement of the hand grip to absorb resiliency in the return motion.

2. The ski pole as recited in claim 1, wherein said friction and positioning sleeve is provided with slot means to permit expansion and contraction radially relative to its lengthwise axis, said ski pole further comprising a tension member pressing said sleeve into frictional engagement with said shaft.

3. The ski pole as recited in claim 2, wherein said tension member engages said sleeve at a lower end thereof to insure firm engagement of the sleeve at the lower end thereof.

4. The ski pole as recited in claim 1, wherein said sleeve is provided with at least one elongate slot extending from a lower end thereof toward the upper end of the sleeve, and said sleeve is adapted to receive therearound a tension member to cause firm frictional engagement of said sleeve with said shaft.

5. The ski pole as recited in claim 4, wherein there are two circumferentially spaced elongate slots separating the lower end of said sleeve into opposed leg members, said ski pole further comprising a resilient band engaging said leg portions of the sleeve to press them into firm engagement with the shaft.

6. The ski pole as recited in claim 4, wherein said slot means comprises a plurality of elongate slots extending from the lower end of said sleeve toward an upper end thereof.

7. The ski pole as recited in claim 1, wherein said sleeve is provided with a plurality of elongate slots arranged in a staggered pattern around the circumference of said sleeve, so that said sleeve can be contracted laterally for firm engagement with said shaft.

8. The ski pole as recited in claim 1, wherein said sleeve is provided with a plurality of inwardly protruding elements which frictionally grip an outside surface of said shaft for frictional engagement therewith.

9. The ski pole as recited in claim 1, wherein said sleeve is provided with slot means which extends circumferentially and upwardly around said sleeve to permit said sleeve to contract radially for firm engagement with the shaft.

10. The ski pole as recited in claim 1, wherein said sleeve and said shaft are arranged to provide recesses therebetween, and there are rotatable friction elements press-fitted in said recesses to provide frictional engagement between said sleeve and said shaft.

11. The ski pole as recited in claim 1, wherein said cylinder and piston assembly is provided with a bleed orifice to permit restricted inflow and outflow of air into and from said compression chamber, whereby during downward movement of said hand grip relative to the shaft, pressurized air in said compression chamber resists downward movement of said hand grip, and during upward movement of said hand grip relative to the lower shaft, lower pressure in said compression chamber tends to retard such return movement.

12. The ski pole as recited in claim 1, wherein said cylinder comprises a side wall and a bottom wall, and said cylinder is mounted in said shaft with an open end thereof facing upwardly, said piston having a piston head mounted for reciprocation in said cylinder and an upwardly extending piston rod connected to said hand grip, said spring means has a lower end mounted from said cylinder and extends upwardly to press said hand grip upwardly, whereby said cylinder and piston define a compression chamber to resist downward movement by said piston, and said spring means is positioned outside of said compression chamber so as not to limit relative movement of said piston and cylinder toward one another.

13. The ski pole as recited in claim 12, wherein matching retaining holes are formed in said cylinder and said shaft, and there is a retaining pin extending through said matching holes and locating said cylinder in said shaft, said sleeve surrounding said shaft to retain said pin in its locating position.

14. The ski pole as recited in claim 13, wherein said hand grip and said sleeve are secured to said piston by removable fastening means.

15. The ski poles are recited in claim 1, wherein:

a. said cylinder has a side wall and bottom wall and is positioned in said shaft with an upper open end thereof facing upwardly, b. said piston has a head mounted for reciprocating motion in said cylinder, and an upwardly extending piston rod, c. said spring means has a lower end extending from said cylinder upwardly to press said hand grip upwardly, d. said friction and positioning sleeve has at least one elongate slot extending from a lower end of said sleeve toward an upper end thereof, said slot permitting radial contraction of said sleeve, and e. there is resilient band means engaging said sleeve and urging it inwardly for proper frictional engagement of said shaft.

16. The ski pole as recited in claim 15, wherein said cylinder and said shaft are provided with matching through holes, and there is a retaining pin extending through said holes to locate said cylinder relative to said shaft, said sleeve extending around said shaft to retain said pin in its locating position, removable fastening means securing said hand grip and said sleeve to said piston.

17. The ski pole as recited in claim 15, wherein said cylinder and piston assembly is provided with a bleed orifice to permit restricted inflow and outflow of air into and from said compression chamber, whereby during downward movement of said hand grip relative to the shaft, pressurized air in said compression chamber resists downward movement of said hand grip, and during upward movement of said hand grip relative to the shaft, lower pressure in said compression chamber tends to retard such return movement.

18. The ski pole as recited in claim 17, wherein said bleed orifice is positioned in a bottom wall of said cylinder, whereby during downward movement of said hand grip relative to the shaft, pressurized air in said compression chamber bleeds into the interior of said shaft, and during upward movement of said hand grip relative to the shaft, air is drawn from the interior of said shaft into said compression chamber through the bleed orifice.

19. The ski pole as recited in claim 15, wherein the coefficient of friction between said sleeve and said shaft is no greater than about 1.0.

20. The ski pole as recited in claim 15, wherein the coefficient of friction between said sleeve and said ski pole is between about 0.3 and 0.7.

21. A shock absorbing hand grip assembly for a ski pole having a hollow shaft, said hand grip assembly comprising:

a. a hand grip adapted to be mounted circumjacent to the upper end of said shaft, b. a pneumatic cylinder and piston assembly adapted to be mounted in the upper end of the shaft, said assembly comprising a first cylinder member adapted to be fixedly connected to one of said shaft and said hand grip, and a piston member adapted to be fixedly connected to the other of said shaft and hand grip and positioned for reciprocating motion in said cylinder, said cylinder and piston defining an air compression chamber to resist relative movement of said hand grip downward relative to the shaft, c. spring means adapted to be mounted in the upper end of said shaft to resist downward movement of the hand grip relative to the shaft and urge the hand grip to an upper position with a first force of a predetermined value, d. stop means to limit upward movement of the hand grip relative to the shaft and e. an elongate friction and positioning sleeve positioned securely within said hand grip and adapted to frictionally engage the outer surface of the upper end of the shaft to exert a frictional force thereagainst less than the first force exerted by said spring means, said sleeve adapted to engage the upper end of the shaft along the length thereof to prevent movement of the hand grip relative to the shaft about an axis perpendicular to a lengthwise axis of the shaft, while permitting relative movement about an axis parallel to the lengthwise axis of the shaft, whereby when the hand grip assembly is mounted to the ski pole and the ski pole is being manipulated with its snow engaging end free of the snow, the friction and positioning sleeve prevents relative movement between the hand grip and the shaft in a manner to give a secure feel to the ski pole, and when the ski pole is planted in a snow surface to push the hand grip downwardly so as to compress the spring means and pressurize the compression chamber to absorb the impact, said friction and positioning sleeve resists return movement of the hand grip to absorb resiliency in the return motion.

22. The hand grip assembly as recited in claim 21, wherein said friction and positioning sleeve is provided with slot means to permit expansion and contraction radially relative to its lengthwise axis, said ski pole further comprising a tension member pressing said sleeve into frictional engagement with said shaft.

23. The hand grip assembly as recited in claim 22, wherein said tension member engages said sleeve at a lower end thereof to insure firm engagement of the sleeve at the lower end thereof.

24. The hand grip assembly as recited in claim 21, wherein said sleeve is provided with at least one elongate slot extending from a lower end thereof toward the upper end of the sleeve, and said sleeve is adapted to receive therearound a tension member to cause firm frictional engagement of said sleeve with said shaft.

25. The hand grip assembly as recited in claim 24, wherein there are two circumferentially spaced elongate slots separating the lower end of said sleeve into opposed leg members, said ski pole further comprising a resilient band engaging said leg portions of the sleeve to press them into firm engagement with the shaft.

26. The hand grip assembly as recited in claim 24, wherein said slot means comprises a plurality of elongate slots extending from the lower end of said sleeve toward an upper end thereof.

27. The hand grip assembly as recited in claim 21, wherein said sleeve is provided with a plurality of elongate slots arranged in a staggered pattern around the circumference of said sleeve, so that said sleeve can be contracted laterally for firm engagement with said shaft.

28. The hand grip assembly as recited in claim 21, wherein said sleeve is provided with a plurality of inwardly protruding elements adapted to frictionally grip an outside surface of said shaft for frictional engagement therewith.

29. The hand grip assembly as recited in claim 21, wherein said sleeve is provided with slot means which extends circumferentially and upwardly around said sleeve to permit said sleeve to contract radially for firm engagement with the shaft.

30. The hand grip assembly as recited in claim 21, wherein said sleeve and said shaft are arranged to provide recesses therebetween, and there are rotatable friction elements press-fitted in said recesses to provide frictional engagement between said sleeve and said shaft.

31. The hand grip assembly as recited in claim 21, wherein said cylinder and piston assembly is provided with a bleed orifice to permit restricted inflow and outflow of air into and from said compression chamber, whereby during downward movement of said hand grip relative to the shaft, pressurized air in said compression chamber resists downward movement of said hand grip, and during upward movement of said hand grip relative to the shaft, lower pressure in said compression chamber tends to retard such return movement.

32. The hand grip assembly as recited in claim 21, wherein said cylinder comprises a side wall and a bottom wall, and said cylinder is adapted to be mounted in said shaft with an open end thereof facing upwardly, said piston having a piston head mounted for reciprocation in said cylinder and an upwardly extending piston rod connected to said hand grip, said spring means has a lower end mounted from said cylinder and extends upwardly to press said hand grip upwardly, whereby said cylinder and piston define a compression chamber to resist downward movement by said piston, and said spring means is positioned outside of said compression chamber so as not to limit relative movement of said piston and cylinder toward one another.

33. The hand grip assembly as recited in claim 32, wherein retaining holes are formed in said cylinder adapted to match retaining holes in said shaft, and there is a retaining pin adapted to extend through said matching holes to locate said cylinder in said shaft, said sleeve being adapted to surround said shaft to retain said pin in its locating position.

34. The hand grip assembly as recited in claim 33, wherein said hand grip and said sleeve are secured to said piston by removable fastening means.

35. The hand grip assembly as recited in claim 21, wherein:

a. said cylinder has a side wall and bottom wall and is adapted to be positioned in said shaft with an upper open end thereof facing upwardly, b. said piston has a head mounted for reciprocating motion in said cylinder, and an upwardly extending piston rod, c. said spring means has a lower end extending from said cylinder upwardly to press said hand grip upwardly, d. said friction and positioning sleeve has at least one elongate slot extending from a lower end of said sleeve toward an upper end thereof, said slot permitting radial contraction of said sleeve, and e. there is resilient band means engaging said sleeve to urge it inwardly for proper frictional engagement of said shaft.

36. The hand grip assembly as recited in claim 35, wherein said cylinder is provided with through holes adapted to match retaining holes in said shaft, and there is a retaining pin adapted to extend through said holes to locate said cylinder relative to said shaft, said sleeve is adapted to extend around said shaft to retain said pin in its locating position, and there is removable fastening means securing said hand grip and said sleeve to said piston.

37. The hand grip assembly as recited in claim 35, wherein said cylinder and piston assembly is provided with a bleed orifice to permit restricted inflow and outflow of air into and from said compression chamber, whereby during downward movement of said hand grip relative to the shaft, pressurized air in said compression chamber resists downward movement of said hand grip, and during upward movement of said hand grip relative to the shaft, lower pressure in said compression chamber tends to retard such return movement.

38. The hand grip assembly as recited in claim 37, wherein said bleed orifice is positioned in a bottom wall of said cylinder, whereby during downward movement of said hand grip relative to the shaft, pressurized air in said compression chamber bleeds into the interior of said shaft, and during upward movement of said hand grip relative to the shaft, air is drawn from the interior of said shaft into said compression chamber through the bleed orifice.

39. The hand grip assembly as recited in claim 35, wherein said sleeve is made up of a material such that upon engagement with said shaft, the coefficient of friction between said sleeve and said shaft would be no greater than about 1.0.

40. The hand grip assembly as recited in claim 35, wherein said sleeve is made up of a material such that upon frictional engagement with said shaft, the coefficient of friction between said sleeve and said shaft is between about 0.3 and 0.7.

41. A method of disassembling a shock absorbing hand grip assembly for a ski pole, shortening the ski pole, and reassembling said hand grip assembly in its operative condition, said method comprising:

a. providing a hand grip assembly for a ski pole having a shaft, wherein said hand grip assembly comprises:
   1. a hand grip mounted circumjacent to the upper end of said shaft,
   2. a pneumatic cylinder and piston assembly mounted in the upper end of the shaft, said assembly comprising a cylinder member and a piston member positioned for reciprocating motion in said cylinder, said cylinder and piston defining an air compression chamber to resist relative movement of said hand grip downward relative to the shaft,
   3. spring means mounted in the upper end of said shaft to resist downward movement of the hand grip relative to the shaft and urge the hand grip to an upper position with a first force of a predetermined value,
   4. a retaining pin extending through pairs of matching holes in said cylinder and said shaft to locate said cylinder in said shaft,
   5. an elongate friction and positioning sleeve positioned securely within said hand grip and frictionally engaging the outer surface of the upper end of the shaft to exert a frictional force thereaginst less than the first force exerted by said spring means, said sleeve engaging the upper end of the shaft along the length thereof to prevent movement of the hand grip relative to the shaft about an axis perpendicular to a lengthwise axis of the shaft, while permitting relative movement about an axis parallel to the lengthwise axis of the shaft,
   6. a removable fastening means connecting said hand grip and said sleeve to said piston, b. disassembling said hand grip assembly by:
   1. removing said removable fastening means from its securing position,
   2. removing said sleeve and said hand grip from said shaft,
   3. removing said pin from said matching holes,
   4. removing said cylinder and piston assembly from said shaft, c. shortening said shaft by removing an upper end portion of said shaft to leave the shaft at the desired length, d. reassembling the hand grip by:
   1. providing in said shaft a second pair of holes adapted to match the holes in said cylinder at a desired location,
   2. reinserting the cylinder and piston assembly in said shaft so that the holes of said cylinder are in alignment with the second pair of holes provided in said shaft,
   3. inserting said pin in said aligned holes,
   4. reassembling said spring means, sleeve and hand grip, and securing the same by means of said removable fastening means.

42. The method as recited in claim 41, wherein said second pair of holes is provided initially in said shaft prior to disassembly and assembly thereof.

43. The method as recited in claim 41, wherein said second pair of holes is drilled in said shaft after disassembly of the hand grip assembly.

44. The method as recited in claim 41, wherein said sleeve is placed around said shaft to retain said locating pin in said aligned holes.

45. A shock absorbing hand grip assembly for a ski pole having a hollow shaft, said hand grip assembly comprising:

a. a hand grip means adapted to be mounted circumjacent to an upper end of said shaft and including tension means to apply a radially inward tension toward said shaft b. resilient means adapted to be positioned in the upper end of said shaft to resist downward movement of said hand grip means relative to said shaft and urge said hand grip means to an upper position relative to said shaft, c. stop means to limit upward movement of said hand grip means relative to said shaft, and d. an elongate friction and positioning sleeve positioned securely within said hand grip means and adapted to frictionally engage an outer surface of the upper end of the shaft to exert a frictional force thereagainst less than the force exerted by said resilient means, said sleeve adapted to engage the upper end of the shaft along the length thereof to prevent movement of the hand grip means relative to the shaft about an axis perpendicular to a lengthwise axis of the shaft, while permitting relative movement about an axis parallel to the lengthwise axis of the shaft, e. said friction and positioning sleeve being provided with slot means to permit expansion and contraction radially relative to its lengthwise axis, with said tension means pressing said sleeve into frictional engagement with said shaft, whereby when said hand grip assembly is mounted to the ski pole and the ski pole is being manipulated with its snow engaging end free of the snow, the friction and positioning sleeve prevents relative movement between the hand grip and the shaft in a manner to give a secure feel to the ski pole, and when the ski pole is planted in the snow surface to push the hand grip downwardly against the urging of the resilient means to absorb the impact, said friction and positioning sleeve resists return movement of the hand grip to absorb resiliency in the return motion.

46. The hand grip assembly as recited in claim 45, wherein said stop means comprises a. an elongate member located in an upper end of said shaft and attached to said hand grip means, said elongate member having a vertical slot, b. a pin member adapted to be attached to said shaft and extending into said slot.

47. The hand grip assembly as recited in claim 45, wherein:

a. said stop means comprises:

1. an elongate member located in an upper end of said shaft and attached to said hand grip means, said elongate member having a vertical slot,
2. a pin member adapted to be attached to said shaft and extending into said slot b. said resilient means comprises a compression spring positioned around said elongate member and above said pin member.

48. The hand grip assembly as recited in claim 45, wherein said sleeve is provided with at least one elongate slot extending from a lower end thereof toward the upper end of the sleeve, and said sleeve is adapted to receive therearound said tension means to cause firm frictional engagement of said sleeve with said shaft.

49. The hand grip assembly as recited in claim 48, wherein there are two circumferentially spaced elongate slots separating the lower end of said sleeve into opposed leg members, said tension means further comprising a resilient band engaging leg portions of the sleeve to press them into firm engagement with the shaft.

50. The hand grip assembly as recited in claim 45, wherein said sleeve is made up of a material such that upon engagement with said shaft, the coefficient of friction between said sleeve and said shaft would be no greater than about 1.0.

51. The hand grip assembly as recited in claim 45, wherein said sleeve is made up of a material such that upon frictional engagement with said shaft, the coefficient of friction between said sleeve and said shaft is between about 0.3 and 0.7.

52. The assembly as recited in claim 45, wherein said tension means comprises a tension member positioned around said sleeve.

53. The hand grip assembly as recited in claim 52, wherein said tension member engages said sleeve at a lower end thereof to insure firm engagement of the sleeve at the lower end thereof.

54. A shock absorbing hand grip assembly for a ski pole having a hollow shaft, said hand grip assembly comprising:

a. a hand grip adapted to be mounted circumjacent to the upper end of said shaft;

b. a pneumatic cylinder and piston assembly adapted to be mounted in the upper end of the shaft, said assembly comprising a first cylinder member adapted to be fixedly connected to one of said shaft and said hand grip, and a piston member adapted to be fixedly connected to the other of said shaft and hand grip and positioned for reciprocating motion in said cylinder, said cylinder and piston defining an air compression chamber to resist relative movement of said hand grip downward relative to the shaft, c. spring means adapted to be mounted in the upper end of said shaft to resist downward movement of the hand grip relative to the shaft and urge the hand grip to an upper position with a first force of a predetermined value, d. stop means to limit upward movement of the hand grip relative to the shaft, and e. said cylinder and piston assembly being provided with a bleed orifice to permit restricted inflow and outflow of air into and from said compression chamber, whereby during downward movement of said hand grip relative to the shaft, pressurized air in said compression chamber resists downward movement of said hand grip, and during upward movement of said hand grip relative to the shaft, lower pressure in said compression chamber tends to retard such return movement.

55. The hand grip assembly as recited in claim 54, wherein said cylinder comprises a side wall and a bottom wall, and said cylinder is adapted to be mounted in said shaft with an open end thereof facing upwardly, said piston having a piston head mounted for reciprocation in said cylinder and an upwardly extending piston rod connected to said hand grip, said spring means has a lower end mounted from said cylinder and extends upwardly to press said hand grip upwardly, whereby said cylinder and piston define a compression chamber to resist downward movement by said piston, and said spring means is positioned outside of said compression chamber so as not to limit relative movement of said piston and cylinder toward one another.

56. The hand grip assembly as recited in claim 54, wherein retaining holes are formed in said cylinder adapted to match retaining holes in said shaft, and there is a retaining pin adapted to extend through said matching holes to locate said cylinder in said shaft, said hand grip assembly being arranged to surround said shaft to retain said pin in its locating position.

57. A method of disassembling a shock absorbing hand grip assembly for a ski pole, shortening the ski pole, and reassembling said hand grip assembly in its operative condition, said method comprising:

a. providing a hand grip assembly for a ski pole having a shaft, wherein said hand grip assembly comprises:

1. a hand grip mounted circumjacent to an upper end of said shaft,
2. an elongate member mounted in the upper end of the shaft,
3. spring means mounted in the upper end of said shaft to resist downward movement of the hand grip relative to the shaft and urge the hand grip to an upper position with a first force of a predetermined value,
4. a retaining pin extending through a slot in said elongate member and through a pair of holes in said shaft,
5. an elongate friction and positioning sleeve positioned securely within said hand grip and frictionally engaging an outer surface of the upper end of the shaft to exert a frictional force thereagainst less than the first force exerted by said spring means, said sleeve engaging the upper end of the shaft along the length thereof to prevent movement of the hand grip relative to the shaft about an axis perpendicular to a lengthwise axis of the shaft, while permitting relative movement about an axis parallel to the lengthwise axis of the shaft, 6. a removable fastening means connecting said hand grip and said sleeve to said elongate member, b. disassembling said hand grip assembly by:

1. removing said removable fastening means from its securing position,
2. removing said sleeve and said hand grip from said shaft,
3. removing said pin from said shaft and from said elongate member
4. removing said elongate member from said shaft, c. shortening said shaft by removing an upper end portion of said shaft to leave the shaft at a desired length, d. reassembling the hand grip by:

1. providing in said shaft a second pair of holes at a desired location,
2. reinserting said elongate member in said shaft so that the slot in the elongate member is in alignment with the second pair of holes provided in said shaft,
3. inserting said pin in said second pair of holes and said slot,
4. reassembling said spring means, sleeve and hand grip, and securing the same by means of said removable fastening means.

58. The method as recited in claim 57, wherein said second pair of holes is provided initially in said shaft prior to disassembly and assembly thereof.

59. The method as recited in claim 57, wherein said second pair of holes is drilled in said shaft after disassembly of the hand grip assembly.

60. The method as recited in claim 57, wherein said sleeve is placed around said shaft to retain said locating pin in said pair of holes.

61. A shock absorbing hand grip assembly for a ski pole having a hollow shaft, said hand grip assembly comprising:

a. a hand grip adapted to be mounted circumjacent to an upper end of said shaft, b. resilient means adapted to be positioned in the upper end of said shaft to resist downward movement of said hand grip relative to said shaft and urge said hand grip to an upper position relative to said shaft, c. stop means to limit upward movement of said hand grip relative to said shaft, d. an elongate friction and positioning sleeve positioned securely within said hand grip and adapted to frictionally engage an outer surface of the upper end of the shaft to exert a frictional force thereagainst less than the force exerted by said resilient means, said sleeve adapted to engage the upper end of the shaft along the length thereof the prevent movement of the hand grip relative to the shaft about an axis perpendicular to a lengthwise axis of the shaft, while permitting relative movement about an axis parallel to the lengthwise axis of the shaft, e. said friction and positioning sleeve being provided with slot means to permit expansion and contraction radially relative to its lengthwise axis, said ski pole further comprising a tension member pressing said sleeve into frictional enagagement with said shaft, whereby when said hand grip assembly is mounted to the ski pole and the ski pole is being manipulated with its snow engaging end free of the snow, the friction and positioning sleeve prevents relative movement between the hand grip and the shaft in a manner to give a secure feel to the ski pole, and when the ski pole is planted in the snow surface to push the hand grip downwardly against the urging of the resilient means to absorb the impact, said friction and positioning sleeve resists return movement of the hand grip to absorb resiliency in the return motion.

62. The hand grip assembly as recited in claim 61, wherein said tension member engages said sleeve at a lower end thereof to insure firm engagement of the sleeve at the lower end thereof.

63. A shock absorbing hand grip assembly for a ski pole having a hollow shaft, said hand grip assembly comprising:

a. a hand grip adapted to be mounted circumjacent to an upper end of said shaft, b. resilient means adapted to be positioned in the upper end of said shaft to resist downward movement of said hand grip relative to said shaft and urge said hand grip to an upper position relative to said shaft, c. stop means to limit upward movement of said hand grip relative to said shaft, d. an elongate friction and positioning sleeve positioned securely within said hand grip and adapted to frictionally engage an outer surface of the upper end of the shaft to exert a frictional force thereagainst less than the force exerted by said resilient means, said sleeve adapted to engage the upper end of the shaft along the length thereof to prevent movement of the hand grip relative to the shaft about an axis perpendicular to a lengthwise axis of the shaft, while permitting relative movement about an axis parallel to the lengthwise axis of the shaft, e. said sleeve being provided with at least one elongate slot extending from a lower end thereof toward the upper end of the sleeve, and said sleeve is adapted to receive therearound a tension member to cause firm frictional engagement of said sleeve with said shaft, whereby when said hand grip assembly is mounted to the ski pole and the ski pole is being manipulated with its snow engaging end free of the snow, the friction and positioning sleeve prevents relative movement between the hand grip and the shaft in a manner to give a secure feel to the ski pole, and when the ski pole is planted in the snow surface to push the hand grip downwardly against the urging of the resilient means to absorb the impact, said friction and positioning sleeve resists return movement of the hand grip to absorb resiliency in the return motion.

64. The hand grip assembly as recited in claim 62, wherein there are two circumferentially spaced elongate slots separating the lower end of said sleeve into opposed leg members, said ski pole further comprising a resilient band engaging leg portions of the sleeve to press them into firm engagement with the shaft.

* * * * *

UNITED STATES PATENT AND TRADEMARK OFFICE

CERTIFICATE OF CORRECTION

PATENT NO. : 4,244,602

DATED : January 13, 1981

INVENTOR(S) : JON I. ALLSOP and DONALD J. STERN

It is certified that error appears in the above-identified patent and that said Letters Patent is hereby corrected as shown below:

Column 6, line 63 - after "16" delete "," and insert -- . This spring 20 is positioned so as to surround the piston rod 46 --.

Column 9, line 19, delete "out" and insert -- our --.

Signed and Sealed this

*Eighth* Day of *February 1983*

[SEAL]

*Attest:*

GERALD J MOSSINGHOFF

*Attesting Officer*

*Commissioner of Patents and Trademarks*